US006447557B1

(12) United States Patent
Yeh et al.

(10) Patent No.: US 6,447,557 B1
(45) **Date of Patent: *Sep. 10, 2002**

(54) DIESEL FUEL COMPOSITION

(75) Inventors: Lisa I-Ching Yeh, Marlton; Richard Henry Schlosberg, Bridgewater, both of NJ (US); Richard C. Miller, Baton Rouge, LA (US); John Richard Bateman, Hermitage (GB); Raf F. Caers, Edegem (BE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/732,374

(22) Filed: Dec. 7, 2000

Related U.S. Application Data

(60) Provisional application No. 60/172,914, filed on Dec. 2, 1999.

(51) Int. Cl.[7] ..... C10L 1/18

(52) U.S. Cl. ..... 44/437; 44/438; 44/439; 44/451; 44/452

(58) Field of Search ..... 44/437, 438, 439, 44/451, 452

(56) References Cited

U.S. PATENT DOCUMENTS

| | | | | |
|---|---|---|---|---|
| 4,207,078 A | * | 6/1980 | Sweeney et al. | |
| 4,378,973 A | | 4/1983 | Sweeney | 44/56 |
| 4,632,675 A | | 12/1986 | Davies et al. | 44/72 |
| 5,004,478 A | | 4/1991 | Vogel et al. | 44/398 |
| 5,308,365 A | | 5/1994 | Kesling, Jr. et al. | 44/447 |
| 5,324,335 A | | 6/1994 | Benham et al. | 44/452 |
| 5,425,790 A | | 6/1995 | Liotta, Jr. et al. | 44/443 |
| 5,645,613 A | | 7/1997 | Benham et al. | 44/452 |
| 5,689,031 A | * | 11/1997 | Berlowitz et al. | 585/734 |
| 5,720,784 A | | 2/1998 | Killick et al. | 44/451 |

FOREIGN PATENT DOCUMENTS

| | | | |
|---|---|---|---|
| EP | 0115382 | 8/1984 | C10G/27/12 |
| EP | 0376453 | 7/1990 | C07C/27/16 |
| EP | 0905217 | 3/1999 | C10L/1/02 |
| WO | WO92/20761 | 11/1992 | C10L/1/02 |
| WO | WO93/24593 | 12/1993 | C10L/1/18 |
| WO | WO96/23855 | 8/1996 | C10L/1/14 |
| WO | WO98/05740 | 2/1998 | C10L/1/08 |
| WO | WO98/34998 | 8/1998 | C10L/1/08 |
| WO | WO98/35000 | 8/1998 | C10L/1/18 |
| WO | WO99/21943 | 5/1999 | C10L/1/18 |

OTHER PUBLICATIONS

"New Findings on Combustion Behavior of Oxygenated Synthetic Diesel Fuels", C. Beatrice et al, Combustion Science and Technology, 1998, vol. 137, pp. 31–50.

(List continued on next page.)

*Primary Examiner*—Margaret Medley
(74) *Attorney, Agent, or Firm*—Joseph J. Allocca

(57) ABSTRACT

This invention relates to an ultra-low sulphur fuel composition comprising (A) a major amount of a base fuel having (a) no more than 50 ppm by weight of sulphur, (b) no more than 10% by weight of olefins and (c) no more than 10% by weight of an ester and (B) at least 1% by weight based on the total fuel composition of an oxygenate selected from its group consisting of a saturated, aliphatic monohydric alcohol having 4 to 20 carbon atoms, ketone having on an average 5 to 25 carbons and mixtures of the alcohol(s) and ketone(s) and having no other oxygen atom in its structure. These specific oxygenates further reduce particulate emissions from the exhausts of engines powered by ultra-low sulphur diesel fuels which fuels are already known to generate low particulate emissions. These oxygenates are capable of an impressive performance with respect to particulate emissions over a broad range of vehicles and driving cycles when compared with the performance of oxygenates used hitherto.

10 Claims, 2 Drawing Sheets

OTHER PUBLICATIONS

"The Effect of Oxygenated Fuels on Emissions from a Modern Heavy–Duty Diesel Engine", F. Liotta, Jr. et al, SAE 932734 (Oct. 18–21, 1993).

"Improvement of Diesel Combustion and Emissions with Addition of Various Oxygenated Agents to Diesel Fuels", N. Miyamoto et al, SAE 962115 (Oct. 14–17, 1996).

"The Effects of Fuel Properties and Oxygenates on Diesel Exhaust Emissions", K. Tsurutani et al, SAE 952349 (Oct. 16–19, 1995).

"Effects of Oxygenated Fuel and Cetane Improver on Exhaust Emission from Heavy–Duty DI Diesel Engines", Y. Akasaka et al, SAE 942023 (Oct. 17–20, 1994).

* cited by examiner

DIESEL FUEL COMPOSITION

This application claims the benefit of U.S. provisional application No. 60/172,914, filed Dec. 21, 1999.

This invention relates to fuel compositions of low sulphur content which contain at least one component capable of reducing particulate emissions from the exhausts of engines which generate power by combustion of such fuels.

Of particular interest are fuels such as diesel which are used widely in automotive transport and for providing power for heavy duty equipment due to their high fuel economy. However, one of the problems when such fuels are burned in internal combustion engines is the pollutants in the exhaust gases that are emitted into the environment. For instance, some of the most common pollutants in diesel exhausts are nitric oxide and nitrogen dioxide (hereafter abbreviated as "$NO_x$"), hydrocarbons and sulphur dioxide, and to a lesser extent carbon monoxide. In addition, diesel powered engines also generate a significant amount of particulate emissions which include inter alia soot, adsorbed hydrocarbons and sulphates, which are usually formed due to the incomplete combustion of the fuel and are hence the cause of dense black smoke emitted by such engines through the exhaust. The oxides of sulphur have recently been reduced considerably by refining the fuel, e.g., by hydrodesulphurisation thereby reducing the sulphur levels in the fuel itself and hence in the exhaust emissions. However, the presence of particulate matter in such exhaust emission has been a more complex problem. It is known that the primary cause of the particulate matter emission is incomplete combustion of the fuel and to this end attempts have been made to introduce into the fuel organic compounds which have oxygen value therein (hereafter referred to as "oxygenates") to facilitate combustion. Oxygenates are known to facilitate the combustion of fuel to reduce the particulate matter and the use of alcohols as oxygenates has been described in the prior art especially with respect to conventional diesel fuels which have a relatively high sulphur content of, e.g., >200 ppm. For instance, U.S. Pat. No. 5,425,790 describes the use of alcohols and glycols for reducing particulate emissions from such relatively high sulphur diesel fuels. The authors confirm that the amount of reduction in particulate matter scales roughly linearly with the oxygen content of the component added although ethers seem to be more effective for reducing particulates than alcohols for the same oxygen content.

U.S. Pat. No. 4,378,973 discloses the use of a combination of cyclohexane and an oxygenated additive for reducing particulate emissions from fuels. This document states that the beneficial effect cannot be achieved in the absence of cyclohexane. This document discloses 2-ethyl hexanol and "EPAL 1012" which comprises a mixture of normal $C_6$–$C_{20}$ alcohols as the oxygenated additives. However, there is no mention of the sulphur content of such fuels.

A further reference, WO 93/24593, is primarily concerned with gasohol blends from diesel and alcohols. This blend must contain 20–70% by volume of ethanol or methanol, 1–15% by volume of a tertiary alkyl peroxide and 4.5–5.5% by volume of a higher straight chain alcohol. The straight chain alcohols disclosed have from 3–12 carbon atoms. According to this reference the presence of a tertiary alkyl peroxide is essential for the performance of the fuel since using 10% v/v alcohol performs no better than a straight diesel whereas 30% v/v of ethanol "severely degraded the engine's operation" (page 8, lines 14–19).

WO 98/35000 relates to lubricity enhancing agents and makes no mention of controlling or reducing emission of particulate matter. This document discloses the use of primary, linear C7+ alcohols in an amount of <5% w/w of a diesel fuel composition.

U.S. Pat. Nos. 5,324,335 and 5,645,613 both in the name of the same assignee relate to fuels produced by the Fischer-Tropsch process which also contain inter alia alcohols formed in situ in the process which is recycled to the process. Whilst several primary alcohols are disclosed most of these are linear except the reference to methyl butanol and methyl pentanol. However, the streams recycled contain a considerable amount of other components such as, e.g., aldehydes, ketones, aromatics, olefins, etc. Also, the amount of alcohols generated by this process, especially the content of branched alcohols (<0.5%), appears to be very low in relation to the total stream recycled. These two do refer to the use of Fischer Tropsch diesel fuels which have a sulphur content of less than 50 ppm.

U.S. Pat. No. 5,720,784 refers to fuel blends and the difficulty in rendering diesel fuels miscible with the conventionally used methanol and ethanol. This document purports to mitigate the problem of miscibility by adding to such formulations a $C_3$ (excluding n-propanol)–$C_{22}$ organic alcohol. However, whilst the document refers to the use of higher alcohols to form single phase compositions which are not prone to separation, it is silent on the nature of the diesel fuel—for these can vary significantly in their composition from light naphtha to heavy duty diesel oils—nor indeed the effect of any of the alcohols referred to on the problems of particulate emissions when using such fuels in diesel fuel powered internal combustion engines. Furthermore, when addressing the issue of miscibility, it fails to distinguish between fuel compositions which contain the lower $C_1$ and $C_2$ alcohols and compositions which contain no lower alcohols. There is no mention of the sulphur content of fuels.

More recently, ashless diesel fuels having an ultra-low sulphur (≦50 ppm) content are also known as Ultra Low Sulphur Automotive Diesel Oil (hereafter "ULSADO"), a density of no more than 835 kg/m$^3$, and a $T_{95}$ (i.e., a temperature by which 95% of the fuel has distilled) of no more than 345° C. have been developed. Such fuels are considered as "clean" diesel fuels and are expected to have lower particulate emissions over a broad range of vehicles than the fuels of relatively higher sulphur content used hitherto.

WO 92/20761 discloses compositions comprising biodiesel in which the base fuels are predominantly esters and alcohols. There is no mention in this document of reducing particulate matter from emissions.

Figure 1A:
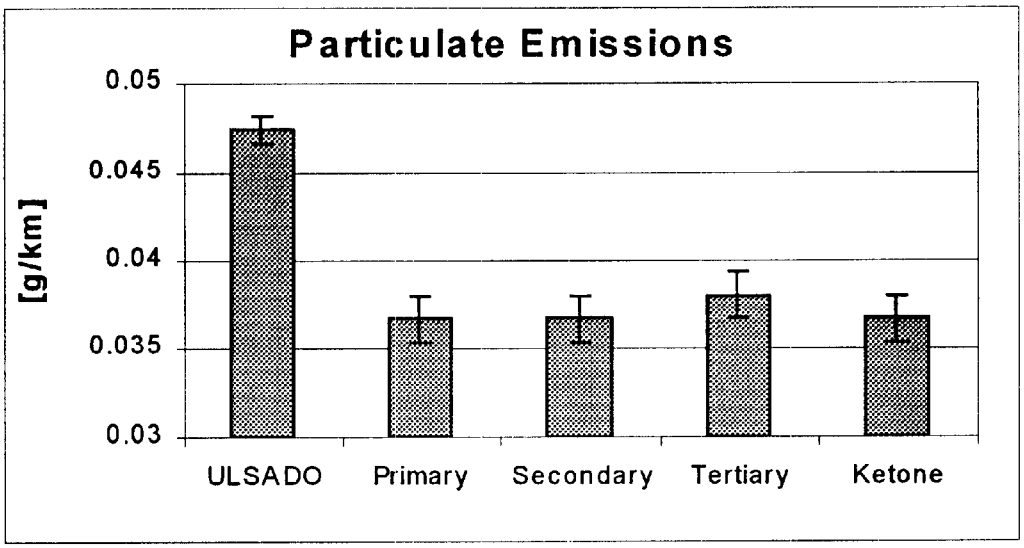
FIGS. 1A and 1B graphically present the data for absolute particulate matter (PM) and $NO_x$ emissions measured for a ULSADO base fuel and the base fuel containing 2% oxygen from primary, secondary and tertiary saturated aliphatic monohydric alcohol and ketone.

It has now been found that certain specific oxygenates when added to the ultra-low sulphur diesel fuels can enable the particulate emissions from the exhausts of engines powered by these relatively clean fuels to be substantially reduced further when compared with some of the additives used hitherto with little to no $NO_x$ increase.

Accordingly, an embodiment of the present invention is a fuel composition comprising a major amount of a base fuel having:

a. no more than 50 ppm by weight of sulphur, b. no more than 10% by weight of olefins, c. no more than 10% by weight of an ester and d. at least 1% by weight based on the total fuel composition of an oxygenate selected from the group consisting of a saturated, aliphatic monohydric primary, secondary, tertiary alcohol and mixture thereof having an average of from 4–20 carbon atoms, one or more mono- or poly-ketones or keto-monohydric aliphatic alcohol having on an average 5 to 25 carbons, and mixtures of the aforesaid and alcohol(s) and ketone(s), and having no other oxygen atom in its structure.

The fuels that may be used as base fuels comprise inter alia distillate fuels, and typically comprise a major amount of diesel fuel, jet fuel, kerosene, bunker fuel or mixtures thereof. The fuels, especially the diesel fuels, are suitably ashless fuels.

The feature of an embodiment of the invention is that the addition of at least one of the aforesaid alcohol(s), ketone(s) or mixture thereof to a base fuel such as, e.g., the ULSADO base fuel—which is considered a "clean fuel"—surprisingly reduces further the particulate emissions from such so called "clean" fuels.

The olefin content of the fuel compositions of an embodiment of the present invention are not intended to include diesel fuels which contain substantial amounts of olefins (e.g., greater than 40% by weight) such as those produced in some of the Fischer-Tropsch processes. In any event, the fuel compositions of an embodiment of the present invention contain no more than 10% by weight of olefins, suitably less than 5% by weight of olefins and preferably less than 2% by weight of olefins. Such fuels may be produced by modified Fischer-Tropsch processes to control the olefins formed therein to below the threshold levels now specified. Furthermore, the base fuel used in the present invention has less than 10% by weight of esters, i.e., the base fuels do not include the so called biodiesels.

The diesel fuel suitably comprises at least 70% by weight, preferably at least 80% by weight of the base fuel, more preferably greater than 85% by weight of the base fuel. The base fuel suitably contains greater than 1% by weight of aromatics, preferably greater than 5% by weight of aromatics and even more preferably from 5–20% by weight of aromatics. The base fuel suitably has a density below 855 $kg/m^3$, preferably no more than 835 $kg/m^3$. The base fuel suitably has a $T_{95}$ of no more than 345° C.

The saturated, aliphatic, monohydric primary, secondary, tertiary alcohols used in the fuel compositions of an embodiment of the present invention may be used singly or as an admixture. The alcohols may also be in the form of an isomeric mixture. The saturated, aliphatic monohydric alcohols used in the compositions of the present invention are suitably primary, secondary, or tertiary alcohols which may be straight chain alcohols, branched chain alcohols or mixtures thereof. The alcohols suitably have on an average from 4–20 carbon atoms, preferably from 6–20 carbon atoms and more preferably from 8–20 carbon atoms. Particularly preferred are alcohols having on average from 9–18 carbon atoms. It is particularly preferable that where a mixture of alcohols is used, and in certain instances where a single alcohol is used, said mixture or single alcohols comprises a predominate amount of at least one of the branched chain alcohol referred to herein. Thus, the alcohols are suitably selected from open chain alcohols, such as, e.g., pentanol, iso-pentanol, hexanol, iso-hexanol, heptanol, iso-heptanol, octanol, iso-octanol, 2-ethylhexanol, nonanol, iso-nonanol, 2-propyl heptanol, 2,4-dimethyl heptanol, decanol, iso-decanol, undecanol, iso-undecanol, dodecanol, iso-dodecanols, tridecanol, iso-tridecanol, tetradecanol, iso-tetradecanol, myristyl alcohol, hexadecanol, octadecanol, stearyl alcohol, isostearyl alcohol, eicosanol, di-isobutyl carbinol, tetrahydro-linalool and mixtures thereof, especially Exxal®-10, Exxal®-12 and Exxal®-13. In these expressions the term "iso" is generally meant to indicate a mixture of branched alcohols. For instance, iso-nonanol represents a mixture containing approximately 85% 3,5,5-trimethyl hexanol, iso-decanol represents a mixture of $C_9$–$C_{11}$ alcohols, iso-dodecanol represents a mixture of $C_{11}$–$C_{13}$ alcohols, isotri-decanol a mixture of $C_{12}$–$C_{14}$ alcohols and iso-tetradecanol is a mixture of linear and branched chain $C_{13}$–$C_{15}$ alcohols. Several of the alcohols referred to herein may be derived from natural sources. These alcohols, for instance, belong to two families, i.e., the lauric oils (primarily from coconut oil, palm kernel oil and jojoba oil) and the stearic oils. The lauric oils give rise to alcohols in the $C_6$–$C_{18}$ range peaking in $C_{12}$–$C_{14}$ (respectively $C_{12}$=lauryl alcohol and $C_{14}$=myristyl alcohol) alcohols. The stearic oils led to alcohols in the $C_{14}$–$C_{22}$ range peaking in $C_{16}$–$C_{18}$ (respectively $C_{16}$=cetyl alcohol and $C_{18}$=stearyl alcohol) alcohols. Since these are generally produced by hydrogenation of the corresponding acids or methyl esters, these alcohols are considered to be saturated alcohols. It is the intention to embrace within its scope the use of such alcohols and mixtures thereof in the fuel compositions. Particularly preferred examples of the alcohols that may be used are iso-nonanol and iso-decanol.

The term ketone includes mono- and poly-ketone or keto-monohydric aliphatic alcohol may contain straight chain or branched chain aliphatic groups and mixtures thereof attached to the central carbonyl (C=O) group, or aromatic or naphthenic groups, or mixtures of aliphatic and aromatic groups, preferably one or both of the groups are aliphatic groups which may themselves be substituted with aryl moiety (e.g., phenyl, napthyl groups, etc.), preferably the alkyl groups are unsubstituted. The ketones suitably have on an average 5 to 25 carbon atoms, preferably on an average 5 to 21 carbon atoms, more preferably on an average of 7–21 carbons, still more preferably on an average of 7–17 carbons. Examples of suitable ketones include di-n-propyl ketone, cyclo-pentanone, cyclohexanone, methyl undecylketone, 8-pentadecanne, 2-hepta-decanone, 9-eicosanone, 10-heneicosanone, and 2-doeicosanone as well as alkyl derivatives thereof and mixtures thereof. The ketones most preferred are open chain ketones such as di-ethyl ketone, methyl propyl ketone, methyl isopropyl ketone, ethyl propyl ketone, ethyl isopropyl ketone, di-n-propyl ketone, di-isopropyl ketone, isopropyl isobutyl ketone, di-n-butyl ketone, di-isobutyl ketone, di-n-pentyl ketone, di-isopentyl ketone, isobutyl isopentyl ketone, isopropyl isopentyl ketone, di-n-hexyl ketone, di-isohexyl ketone, isopentyl isohexyl ketone, and other ketones having aliphatic groups wherein each aliphatic group is independently a straight chain, singly branched chain or multiply branched chain aliphatic group. As previously stated, also included are hydrocarbons with multiple ketone functions as well as with mixed ketone and monohydric aliphatic alcohol function (e.g., keto-monohydric aliphatic alcohol), such keto-monohydric aliphatic alcohol having up to 25 carbons in total.

The fuel compositions are suitably substantially free of $C_1$–$C_2$ alcohols, i.e., they are present in an amount of <5% by weight, preferably ≦1% by weight, of the total composition.

The amount of any of the oxygenates referred to above and used in the compositions of the present invention is at least 1% by weight of the total composition and is such that it is capable of providing the composition with at least 0.5% w/w of oxygen, suitably at least 1.0% by weight of oxygen and preferably at least 2% by weight of oxygen. Thus to achieve this composition, the amount of oxygenate added to the composition is suitably greater than 2% by weight of the total composition, and is preferably greater than 5% w/w and more preferably greater than 7% by weight of the total composition. Typically, the oxygenate(s) is (are) used in an amount in the range from 7 to 60% by weight, preferably from 7 to 40 % by weight of the total composition. Within these ranges, it would be possible to use a relatively low amount of a specific oxygenate, if said oxygenate has a relatively high oxygen content and conversely, one may have to use a higher amount of a particular oxygenate, if it is relatively low in oxygen content. This improved performance in reducing particulate emission is achieved without recourse to the use of further additives such as, e.g., cyclohexane or peroxides or the use of aromatic alcohols. A further feature is that these oxygenates are capable of an impressive performance with respect to particulate emissions over a broad range of vehicles and driving cycles when compared with the performance of esters, glycols and ethers used hitherto for this purpose which perform only over a restricted range of vehicles and driving cycles. An additional feature is that the particulate reduction is obtained with little to no increase in NOx emissions at high engine loads.

The diesel fuel composition may contain one or more conventional fuel additives, which may be added at the refinery, at the fuel distribution terminal, into the tanker, or as bottle additives purchased by the end user for addition into the fuel tank of an individual vehicle. These additives may include cold flow improvers (also known as middle distillate flow improvers), wax antisettling additives, diesel fuel stabilizers, antioxidants, cetane improvers, combustion improvers, detergents, demulsifiers, dehazers, lubricity additives, anti-foamants, anti-static additive, conductivity improvers, corrosion inhibitors, drag reducing agents, reodorants, dyes and markers, and the like.

Fuels compositions of an embodiment of the present invention were prepared by blending a fuel having no more than 10% by weight of olefins and no more than 10% by weight of an ester with at least 5% by weight based on the total composition of at least one saturated, aliphatic monohydric alcohol having on average from 4–20 carbon atoms, or a ketone having on an average of 5 to 25 carbons.

The alcohols used in an embodiment of the fuel compositions were evaluated for their performance in reducing particulate emission using a single cylinder Caterpillar 3406 HD engine (which is a Cat 1Y450 engine) with gaseous emission analyses for: hydrocarbons, $NO_x$, carbon monoxide, carbon dioxide, oxygen (Horiba, Mexa-9100 DEGR) and a full dilution particulate tunnel (Horiba, DLS-9200). The particulates generated in the combustion process are collected on a 70 mm diameter Whatman GF/A glass fibre filter paper after the primary dilution tunnel. No secondary dilution is used. The filter papers used are stabilized and weighed both before and after testing. Stabilization conditions are at a temperature of 20±2° C. and at a relative humidity of 45±10%. The difference in weight measured is taken to be the mass of particulate matter collected. The analytical and sampling systems for particulate collection conform to EEC Directive 88/77/EEC.

The performance of the compositions and additives of the present invention are further illustrated with reference to the following Examples and Comparative Tests:

EXAMPLE 1

In this Example the following base fuels and alcohols are used:

LSADO—Low sulphur automotive diesel oil (ex Esso's Fawley refinery) having the following characteristics:

Density—851 kg/m$^3$

KV20 (cSt)—5.03

Sulphur content—400 ppm $T_{95}$—343° C.

ULSADO—Ultra-low sulphur automotive diesel oil (ex Esso's Fawley refinery) having the following characteristics:

Density—825 kg/m$^3$ $kV_{20}$ (cSt)—3.41

Sulphur content—31 ppm $T_{95}$—314° C.

Exxal® 10—Isodecanol (CAS No. 93821-11-5, EINECS No. 2986966, ex Exxon Chemicals)

Iso-nonanol—A mixture rich (80+% by weight) in 3,5,5-trimethylhexanol (CAS No. 3452-97-9, EINECS 222-376-7)

PM—Particulate Matter

The four fuel compositions tested were:

Fuel 1—LSADO

Fuel 2—ULSADO

Fuel 3—ULSADO+19.7% w/w Exxal®-10 providing the fuel with 2% w/w oxygen content, and Fuel 4—ULSADO+18.0 % w/w Isononanol providing the fuel with 2% w/w oxygen content.

Emissions testing was carried out in a single cylinder version of the Caterpillar 3406 heavy duty engine. A full dilution tunnel with a primary dilution ratios of about 15:1 at low load was used for particulate collection and analysis. Dynamic injection timing was kept constant for the range of fuels tested and the engine was supercharged using two external Roots pumps. The steady state condition used for testing was at 1500 rpm and the low load condition was 60 Nm. The dimensions of the engine used for testing are shown in Table 1 below:

TABLE 1

| Engine | Cat 1Y540 |
|---|---|
| Bore (mm) | 137.2 |
| Stroke (mm) | 165.1 |
| Swept Volume (liters) | 2.43 |
| Compression ratio | 13.37:1 |
| Aspiration | Simulated turbo-charged |

Each fuel was tested over 6 days in a randomized fuel test sequence for each day to simulate varied driving conditions. Particulate emissions from the engine exhausts were collected on two filter papers for 10 minutes each and these results were averaged to generate the data point for each fuel for each day.

The resultant particulate results are listed in Table 2 below for each fuel averaged over 6 test repeats as a % change compared to LSADO, the base diesel fuel with 400 ppm sulphur.

TABLE 2

| Fuel Type | Blend Quantity (wt %) | Oxygen (wt %) | PM Mass (g/kWh) | % Change compared to LSADO |
|---|---|---|---|---|
| 1 - LSADO | 0.0 | 0.0 | 0.485 | 0.0 |
| 2 - ULSADO | 0.0 | 0.0 | 0.377 | −22.4 |
| 3 - ULSADO + Exxal ®-10 | 19.7 | 2.0 | 0.339 | −30.1 |
| 4 - ULSADO + Iso-nonanol | 18.0 | 2.0 | 0.329 | −32.3 |

From the above results it can be seen that the use of ULSADO did reduce the particulate matter emissions under the low load conditions used by 22.4% when compared with the LSADO fuel. However, upon addition of the branched chain alcohols according to an embodiment of the present invention, the particulate matter emissions were surprisingly reduced a further 7.7% for Exxal®-10 and 9.9% for Iso-nonanol compared to the ULSADO fuel without these additives thus resulting in a total particulate matter reduction in the emissions of 30.1% and 32.3% respectively relative to the LSADO fuel. Both these reductions are substantial and were surprisingly large since the emissions from ULSADO as such were already quite low.

EXAMPLE 2

The base fuel used was a Fawley ULSADO and this was blended with the appropriate amount of oxygenate to achieve an oxygen content in the final blend of 2% by weight. A primary alcohol, secondary alcohol, tertiary alcohol and ketone were selected for screening. The fuel details are shown in Table 5.

TABLE 3

| Blend Ref | Fuel | Description | % weight oxygenate |
|---|---|---|---|
| | UK ULSADO | Base Fuel | 0 |
| TO | Base + Isodecanol | Primary: Exxal 10 | 18.74 |
| TL | Base + Dimethyl Heptanol | Secondary: Di-isobutyl carbinol | 18.0 |
| TN | Base + Dimethyl Octanol | Tertiary: Tetrahydrolinalool | 19.75 |
| TM | Base + Dimethyl Heptanone | Ketone: Di-isobutyl ketone | 17.75 |

Testing was carried out on a single vehicle. The VW Golf 1.9 TDI was selected. This vehicle is a 1.9 liter turbocharged intercooled DI engine with an oxidation catalyst mounted very close to the engine block, exhaust gas recirculation, and an electronically controlled distributor fuel pump with a needle lift sensor allowing for closed loop control of injection timing.

The fuel blends were tested according to a specific test protocol and involved testing a base fuel against a different test fuel each day. The base fuel was tested first followed by the test fuel which was tested three times in succession followed by a final base fuel test (base 1, test1, test2, test3, base2). Each of these five tests comprised a hot ECE+EUDC drive cycle. Gaseous and particulate emissions were collected for each test.

Results and Discussion

Figure 1B:
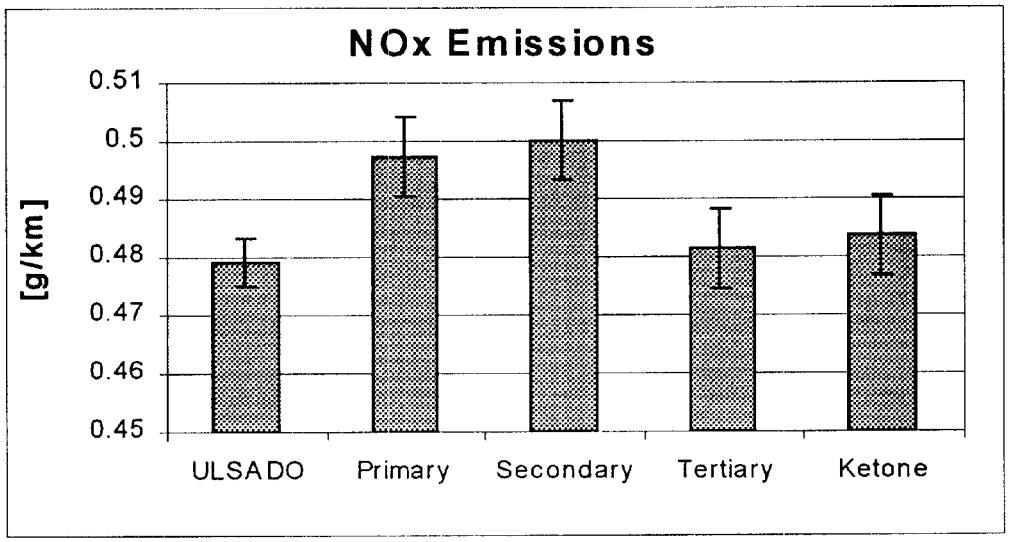

Shown in FIGS. 1A and 1B and Table 4 are the data for absolute PM and $NO_x$ emissions measured for each fuel. In the Figures the bars show the 95% least significant difference limits and if these do not overlap then there is said to be significant difference between fuels. All 4 oxygenates showed substantial and significant reductions in particulate emissions relative to the base ULSADO fuel. There was no statistically significant difference between the type of oxygenates used. All 4 oxygenated blends also generated higher absolute emissions of $NO_x$ than for the ULSADO. However, for the tertiary alcohol and the ketone these increases were only small and not statistically significant at the 95% level, as compared with the base fuel UK ULSADO.

Figure 2:
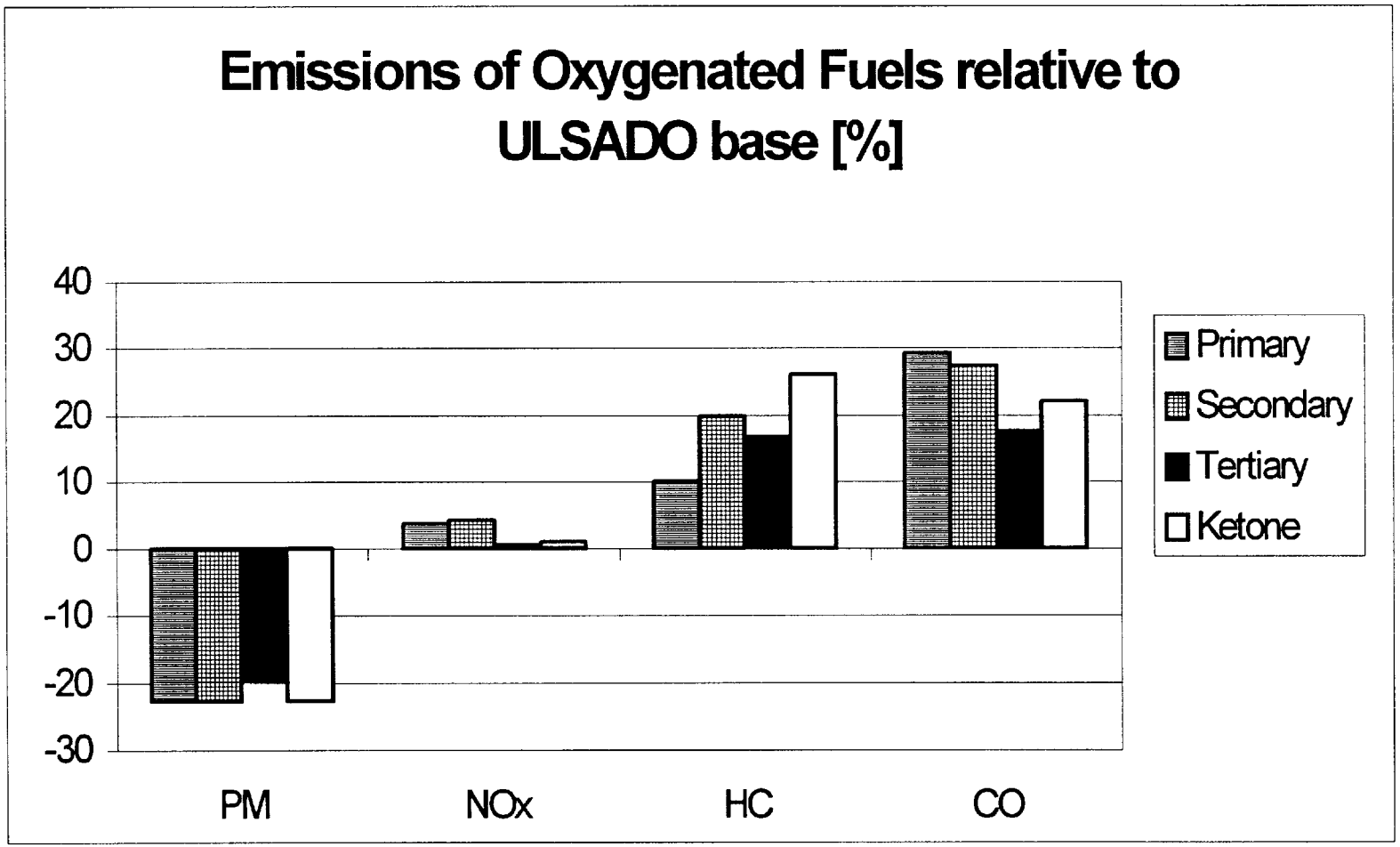
FIG. 2 graphically presents and compares the emissions data relating to PM, $NO_x$, HC, and CO for ULSADO fuel additized with primary, secondary and tertiary saturated aliphatic monohydric alcohols and ketone.

FIG. 2 and Table 6 shows the relative change in emissions of each oxygenated blend compared with the base fuel. The differences observed from FIGS. 1A and 1B are clearly represented here. Reductions in particulate emissions varied from 19.8% (tertiary alcohol) to 22.6% (primary & secondary alcohols and ketone). The corresponding increases in $NO_x$ emissions relative to ULSADO were 0.5% (tertiary), 1.0% (ketone), 3.8% (primary) and 4.4% (secondary). The addition of an oxygenate to the base diesel fuel also had the effect of increasing HC and CO emissions, although these can be more easily controlled using an oxidation catalyst, now common on all light-duty diesel vehicles. The increase in HC and CO emissions do not outweigh the significance and importance of the reduction in particulate matter.

TABLE 4

| Fuel | CO g/km | $CO_2$ g/km | HC g/km | $NO_x$ g/km | PM g/km |
|---|---|---|---|---|---|
| ULSADO | 0.230 | 130.1 | 0.064 | 0.479 | 0.047 |
| Primary | 0.297 | 128.5 | 0.071 | 0.497 | 0.037 |
| Secondary | 0.292 | 128.4 | 0.077 | 0.500 | 0.037 |
| Tertiary | 0.270 | 129.4 | 0.075 | 0.481 | 0.038 |
| Ketone | 0.280 | 128.2 | 0.081 | 0.484 | 0.037 |

Difference from ULSADO base [%]

| Fuel | CO | $CO_2$ | HC | $NO_x$ | PM |
|---|---|---|---|---|---|
| Primary | 29.27095 | −1.2042 | 9.98703 | 3.827418 | −22.6033 |
| Secondary | 27.23975 | −1.28107 | 19.84436 | 4.384134 | −22.6033 |
| Tertiary | 17.51904 | −0.56367 | 16.73152 | 0.487126 | −19.7889 |
| Ketone | 22.01668 | −1.46042 | 26.07004 | 0.974252 | −22.6033 |

This data demonstrates that secondary and tertiary alcohols and ketone produce a similar level of reduction in particulate emissions from base fuel to that previously demonstrated with a primary alcohol.

What is claimed is:

1. A fuel composition comprising:

(A) a major amount of a base distillate fuel having
  a. no more than 50 ppm by weight of sulphur,
  b. no more than 10% by weight of olefins,
  c. no more than 10% by weight of an ester
  d. a density below 850 kg/m$^3$ and a $T_{95}$ of no more than 345° C.; and (B) at least 1% by weight based on the total fuel composition of an additive for reducing particulate emissions consisting essentially of an oxygenate selected from the group consisting of saturated, aliphatic monohydric primary, secondary, tertiary alcohol and mixtures thereof having an average of from 4–20 carbon atoms, one or more mono- or poly-ketone or keto-monohydric aliphatic alcohol having on an average 5 to 25 carbons, and mixtures of the aforesaid alcohol(s) and ketone(s) and having no other oxygen atom in its structure, the amount of the oxygenate in the composition being sufficient to provide the fuel with at least 2% by weight of oxygen.

2. The composition according to claim 1 wherein the fuel is an ashless diesel fuel.

3. The composition according to claim 1 wherein the fuel composition contains less than 5% by weight of olefins.

4. The composition according to claim 1 wherein the alcohol has on average from 9–20 carbon atoms.

5. The composition according to claim 1 wherein the saturated, aliphatic monohydric alcohol is a primary alcohol.

6. The composition according to claim 1 wherein the saturated aliphatic monohydric alcohol is a branched chain alcohol.

7. The composition according to claim 1 wherein the ketone has on an average 5 to 21 carbons.

8. The composition according to claim 1 wherein the ketone has on an average 7 to 15 carbons.

9. The composition according to claim 1 wherein the saturated aliphatic monohydric alcohol is selected from pentanol, iso-pentanol, hexanol, iso-hexanol, heptanol, iso-heptanol, octanol, iso-octanol, 2-ethylhexanol, nonanol, isononanol, 2-propyl heptanol, 2,4-dimethyl heptanol, decanol, iso-decanol, undecanol, iso-undecanol, dodecanol, iso-dodecanol, tridecanol, iso-tridecanol, tetradecanol, iso-tetradecanol, myristyl alcohol, hexadecanol, octadecanol, stearyl alcohol, isostearyl alcohol, eicosanol, diisobutyl carbinol, tetrahydrolinalool, and mixtures thereof.

10. A method of reducing particulate emissions from an internal combustion engine powered by a fuel composition comprising a major amount of a base distillate fuel having a. no more than 50 ppm by weight of sulphur, b. no more than 10% by weight of olefins, c. no more than 10% by weight of an ester, d. a density below 850 kg/m$^3$ and a $T_{95}$ of no more than 345° C.;

said method comprising blending said base fuel with at least 1% by weight based on the total fuel composition of an additive consisting essentially of an oxygenate selected from the group consisting of saturated, aliphatic monohydric primary, secondary, tertiary alcohol and mixtures thereof having an average of from 4–20 carbon atoms, one or more mono- or polyketone or keto-monohydric alcohol having on an average 5 to 25 carbons, and mixtures of the aforesaid alcohol(s) and ketone(s), and having no other oxygen atom in its structure, the amount of the oxygenate in the composition being sufficient to provide the fuel with at least 2% by weight of oxygen.

* * * * *